US007344134B1

(12) United States Patent
Keane et al.

(10) Patent No.: US 7,344,134 B1
(45) Date of Patent: Mar. 18, 2008

(54) LARGE ENVELOPE ON-EDGE STACKING CONVEYOR

(75) Inventors: Joseph J. Keane, Telford, PA (US); Donato C. Farole, Lehighton, PA (US); Mark W. Ricker, Tatamy, PA (US); Kurt D. Schultz, Schnecksville, PA (US)

(73) Assignee: KFW Automation, Inc., Allentown, PA (US)

( * ) Notice: Subject to any disclaimer, the term of this patent is extended or adjusted under 35 U.S.C. 154(b) by 395 days.

(21) Appl. No.: 11/010,584

(22) Filed: Dec. 13, 2004

(51) Int. Cl.
*B65H 29/40* (2006.01)

(52) U.S. Cl. ..... 271/178; 271/177; 271/181; 271/213; 271/214; 271/215

(58) Field of Classification Search ..... 271/181, 271/213, 214, 215, 177, 178
See application file for complete search history.

(56) References Cited

U.S. PATENT DOCUMENTS

| | | | | |
|---|---|---|---|---|
| 582,593 | A | | 5/1897 | Waite |
| 2,841,394 | A | * | 7/1958 | Stobb ..... 271/185 |
| 3,342,481 | A | | 9/1967 | Kaplan |
| 4,432,540 | A | | 2/1984 | Akers et al. |
| 4,570,922 | A | | 2/1986 | Akers |
| 4,705,157 | A | | 11/1987 | Bowles |
| 4,718,660 | A | | 1/1988 | Daboub |
| 4,903,955 | A | | 2/1990 | Manzke |
| 4,940,219 | A | | 7/1990 | Volat |
| 5,029,832 | A | | 7/1991 | Orsinger et al. |
| 5,129,503 | A | | 7/1992 | Belec et al. |
| 5,201,504 | A | | 4/1993 | Fallos et al. |
| 5,211,384 | A | | 5/1993 | Orsinger et al. |
| 5,217,218 | A | | 6/1993 | Ricciardi |
| 5,221,080 | A | | 6/1993 | Ricciardi |
| 5,368,287 | A | | 11/1994 | Belec et al. |
| 5,372,360 | A | | 12/1994 | Ricciardi |
| 5,411,250 | A | | 5/1995 | Belec et al. |
| 5,429,249 | A | | 7/1995 | Belec et al. |
| 5,485,989 | A | | 1/1996 | McCay et al. |
| 5,709,525 | A | | 1/1998 | Marzullo et al. |
| 5,960,963 | A | | 10/1999 | Chodack et al. |

(Continued)

FOREIGN PATENT DOCUMENTS

| | | |
|---|---|---|
| BE | 519942 | 11/1953 |

(Continued)

*Primary Examiner*—Patrick Mackey
*Assistant Examiner*—Howard Sanders
(74) *Attorney, Agent, or Firm*—Caesar, Rivise, Bernstein, Cohen & Pokotilow, Ltd.

(57) ABSTRACT

A stacking apparatus for stacking a plurality of flat articles on edge is provided that receives articles in an article receiver that includes a stop wall to receive the front edge of each article and stop horizontal motion of the article and a rotatable segmented roller for receiving the bottom edge of each article. The segmented roller is rotatable about a central axis of the cylinder and includes a planar surface, the planar surface receiving the bottom edge of each flat article when the planar surface is in a horizontal position. The segmented roller is rotatable from a stopped position wherein the planar surface is in the horizontal position to form a gap to receive the bottom edge of one article at a time to a rotating configuration wherein the cylindrical outer surface of the segmented roller drives the one article against a stacking conveyor bed.

12 Claims, 7 Drawing Sheets

U.S. PATENT DOCUMENTS

| | | | | |
|---|---|---|---|---|
| 5,971,161 | A | 10/1999 | Branecky et al. | |
| 6,241,460 | B1 | 6/2001 | Werner | |
| 6,398,204 | B1 | 6/2002 | Keane et al. | |
| 6,540,223 | B2 | 4/2003 | Keane et al. | |
| 6,634,639 | B2 * | 10/2003 | Kuroda et al. | 271/178 |
| 6,682,067 | B1 | 1/2004 | Keane et al. | |
| 6,793,212 | B2 * | 9/2004 | Holbrook | 271/2 |

FOREIGN PATENT DOCUMENTS

| | | |
|---|---|---|
| DE | 1 289 491 | 2/1969 |
| JP | 406 127784 A2 | 5/1994 |
| WO | WO 93/18996 | 9/1993 |

* cited by examiner

FIG.3
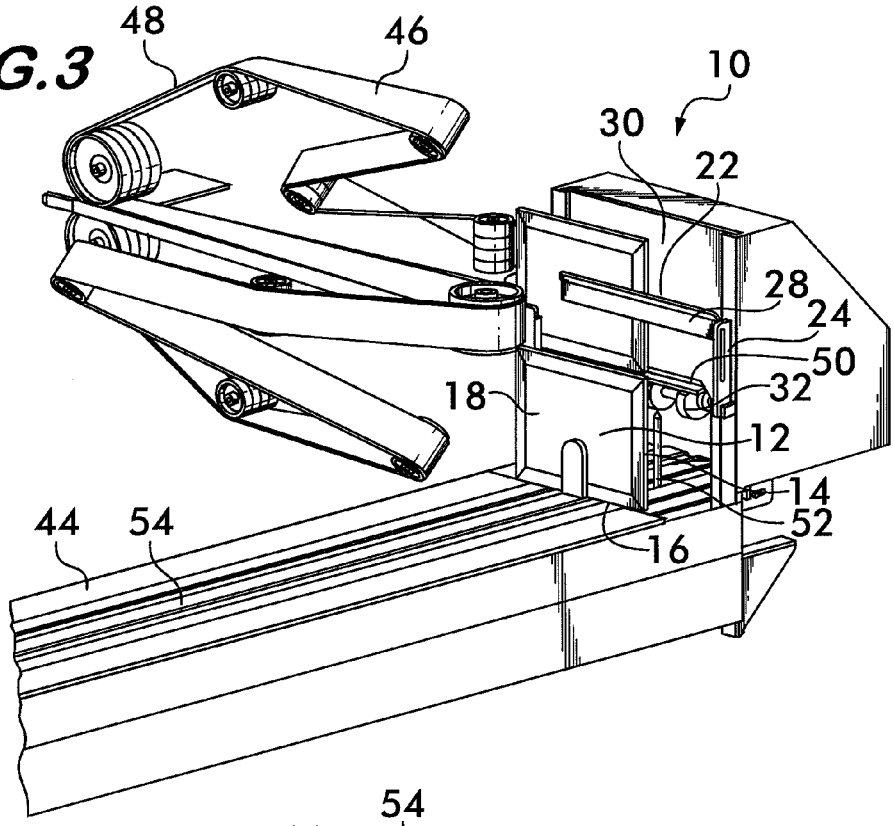
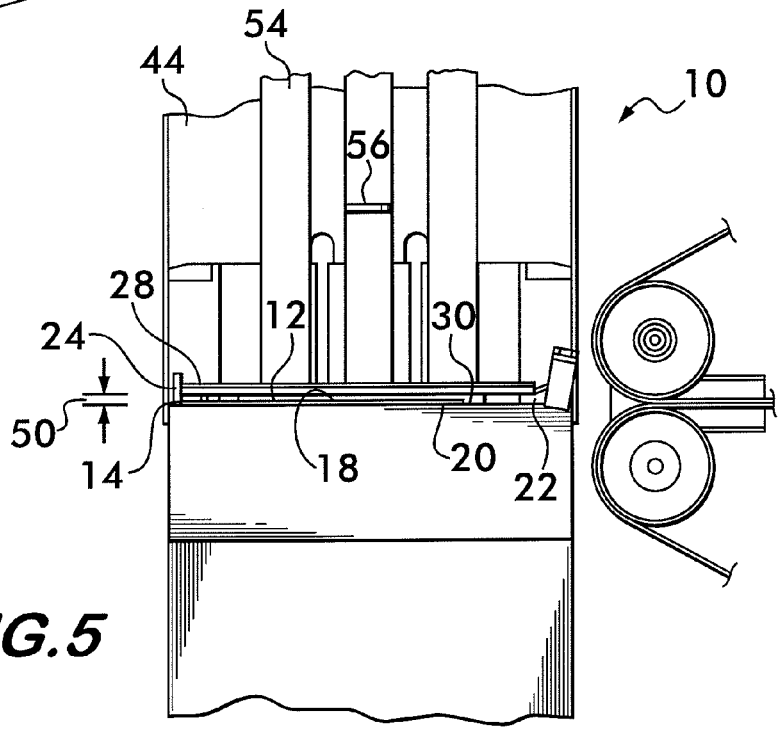
FIG.5

LARGE ENVELOPE ON-EDGE STACKING CONVEYOR

BACKGROUND OF THE INVENTION

This invention relates generally to mass mail handling equipment. More particularly, this invention relates to an improved apparatus for taking a series of flat articles such as envelopes, orienting them, and then stacking the articles in groupings.

In the high volume mail industry, in both U.S. First Class and Third Class mail, envelopes are filled with various letter pieces using automated mail inserters. For example, U.S. Pat. Nos. 5,029,832 (Orsinger et al.) and 5,211,384 (Orsinger et al.) disclose an in-line inserter device having envelope and feeding assemblies, an envelope inserting station, a sealing and stacking assembly, and various diverter stations.

Mass-mailing equipment has become very diverse in its functions. For instance, inserting equipment transports envelopes along an inserting track while various types of inserts are automatically inserted into the envelopes. The envelopes are normally transported to another piece of equipment that automatically seals the envelopes, weighs them and affixes postage. Still additional equipment automatically reads the zip codes or zip code indicia on the envelopes and indicates zip code breaks in the envelope groups for zip code presorting. This allows the user to take advantage of lower postage rates. Other mass-mailing equipment may include remittance processing equipment and zip code sorting equipment.

These mail-inserters may run at speeds, for example, from several hundred filled envelopes per hour to approximately 14,000 envelopes per hour. These speeds have created a need on the end of the inserters to collect the filled envelopes in such a way as to allow the operator to load them into mail trays or other forms of storage quickly and efficiently. In addition, since these envelopes are often prearranged in special zip code order, this order must be maintained by the operator and then separated into different trays depending on these zip code groupings.

U.S. Pat. Nos. 6,398,204 (Keane et al.) and 6,540,223 (Keane et al.) address these issues, however, these methods have limitations as the envelopes being processed become larger. The invention of these two patents rely on sliding the incoming envelope behind the previously stacked envelope. However, this invention may create difficulties when dealing with the larger "flat" envelopes (flats being defined as envelopes that are approximately six inches by nine inches and larger). Because these envelopes tend to have more documents in them and thus be thicker, and because of the increased surface area of these envelopes, they have difficult sliding behind the previous envelope efficiently.

Currently, many mail inserters simply eject the filled envelope onto a short flat conveyor, allowing the envelopes to free float on the conveyor. This creates the possibility that the zip order of the envelopes will get mixed up, the possibility of envelopes becoming disorderly and difficult to quickly pick up, and the possibility of envelope flaps popping opened prior to proper glue drying. Additionally, this method is an inefficient use of conveyor space, allowing only a short amount of time before the conveyor becomes full. All of these limitations require increased attention from an operator. Often, an operator is forced to shut down the entire inserting machine so that he or she can catch up with the emptying of the conveyor. Obviously, this drastically reduces the overall throughput of envelopes.

These mail inserters may run at speeds, for example, from several hundred filled envelopes per hour to approximately 18,000 envelopes per hour. These speeds have created a need on the end of the inserters to collect the filled envelopes in such a way as to allow the operator to load them into mail trays or other forms of storage quickly and efficiently. In addition, since these envelopes are often prearranged in special zip code order, this order must be maintained by the operator and then separated into different trays depending on these zip code groupings.

This area has proven to be the "bottleneck" of the mail insertion process. Many times, the operator has a difficult time keeping up with the inserter. Additionally, the envelopes are not presented in such a way that the zip code breaks can be read easily. The operator may develop fatigue, possibly even carpal tunnel syndrome, because of excess handling of envelopes. One means to assist here is the inclusion of an envelope stacking apparatus at the end of the system to secure the sorted mail pieces in a stacked position to facilitate the orderly removal of the processed mail pieces from the system.

One feature of many on-edge stacking conveyors is the ability to offset the registered edge of a horizontal envelope stack so as to easily identify the zip code change or count to the offloading operator. This is typically accomplished by a printing, such as a zip code, bar code, optical mark, etc., on the envelope, read by an electronic reading device, as the envelope enters the on-edge stacking apparatus. This data is then used to index an offsetting device that causes the front perimeter edge of the envelope stack to create an offset from the envelopes previously received in the stack. That is, a series of envelopes is first stacked against a register wall. When a new zip code break is read, the offset device causes new envelopes to be offset by a small amount. The result is an indexed stack with zip code breaks easily identified. In present systems, after a set of envelopes has been offset by the offset device and a new zip code break is read, the next set of envelopes coming in no longer is required to be offset. However, the first incoming envelope of a new set may drag the prior, offset, envelope back to the register wall due to frictional drag. This occurs particularly when the offset device is withdrawn too soon. This may be overcome by delaying, for example, via software, the moment when the parallel wall of the offset device is retracted to several inches before the new envelope gets to the offset device. This solution is only partially successful because the retraction of the offset device must be started early because the front lip of the offset must be clear before the new envelope passes it. Because there are still several inches of travel for the incoming envelope, there is still some frictional drag of the prior envelope.

The present invention is directed to these limitations in past systems.

Many other attendant features of this invention will become readily appreciated as the same becomes better understood by reference to the following detailed description when considered in connection with the accompanying drawings.

All references cited herein are incorporated herein by reference in their entireties.

BRIEF SUMMARY OF THE INVENTION

A stacking apparatus for stacking a plurality of flat articles on edge is provided where each article has a front perimeter edge, a bottom edge and two faces. The stacking apparatus is adapted to receive each of the plurality of flat articles as each article enters the stacking apparatus where the articles are moving in a direction generally parallel to the faces of each article. The stacking apparatus includes an article receiver that is adapted to receive articles when the faces of the article are in a vertical position. The article receiver includes a stop wall to receive the front perimeter edge of each article and stop horizontal motion of the article and to align the front perimeter edge of each article. The article receiver further includes a rotatable segmented roller for receiving the bottom edge of each article.

The segmented roller includes an elongated cylinder rotatable about a horizontal central axis of the cylinder and at least one planar surface that is substantially parallel to the horizontal central axis of the cylinder. The planar surface forms a shelf to receive the bottom edge of each flat article when each article enters the article receiver when the planar surface is rotated to a horizontal position. The segmented roller has a generally cylindrical outer surface.

The stacking apparatus further includes a stacking conveyor bed.

The segmented roller is rotatable from a stopped position to a rotating configuration. When the segmented roller is in the stopped position, the planar surface is in the horizontal position to form a shelf and wherein the planar surface forms a gap to receive the bottom edge of one article at a time. When the segmented roller is in a rotating configuration, the cylindrical outer surface of the segmented roller drives the article against the stacking conveyor bed. The segmented roller is then rotatable back to the stopped position wherein the planar surface is back in the horizontal position to receive the bottom edge of another article.

Preferably, the stacking apparatus includes a belt turn-up mechanism to turn the article from a position wherein the faces of the article are in a position other than vertical to a position wherein the faces are in a vertical position, for receipt into the article receiver. Additionally, in a preferred embodiment, an article face receiver on the stacking conveyor bed is included that is indexed on the conveyor bed to provide for an incremental amount of space for additional articles received on the conveyor bed.

A stack pressure sensor may be included on the conveyor bed wherein the article face receiver is indexed when the stack pressure sensor senses sufficient pressure caused by a stack of articles on the conveyor bed. Preferably, the conveyor bed is movable along a conveyor to provide additional space, as required, for articles and to provide a compressive force to the stack of articles.

In a preferred configuration, the article receiver comprises a front guide and a back wall and the segmented roller includes a single planar surface which is adapted to rotate three hundred sixty degrees for each article received.

Preferably, the segmented roller is stationary during the receiving of each article and subsequently rotates to drive that article against the stacking conveyor bed. However, the segmented roller may rotate at a continuous rate.

An article stack offset device may be included to periodically move the stop wall to provide a mark for a change in an article parameter such as a zip code. The article stack offset device may provide a mark for a change in an article parameter such as a zip code, or at specific article counts or when a signal is received.

BRIEF DESCRIPTION OF SEVERAL VIEWS OF THE DRAWINGS

The invention will be described in conjunction with the following drawings in which like reference numerals designate like elements and wherein:

FIG. 3 is a partial isometric view of the large envelope on-edge stacking conveyor of FIG. 1, showing an envelope entering a belt turn-up mechanism and showing another envelope exiting the belt turn-up mechanism and entering a conveyor bed;

FIG. 5 is a partial, top, plan view of the large envelope on-edge stacking conveyor of FIG. 1, showing an envelope against the stop wall and a back wall;

DETAILED DESCRIPTION OF THE INVENTION

Figure 1:
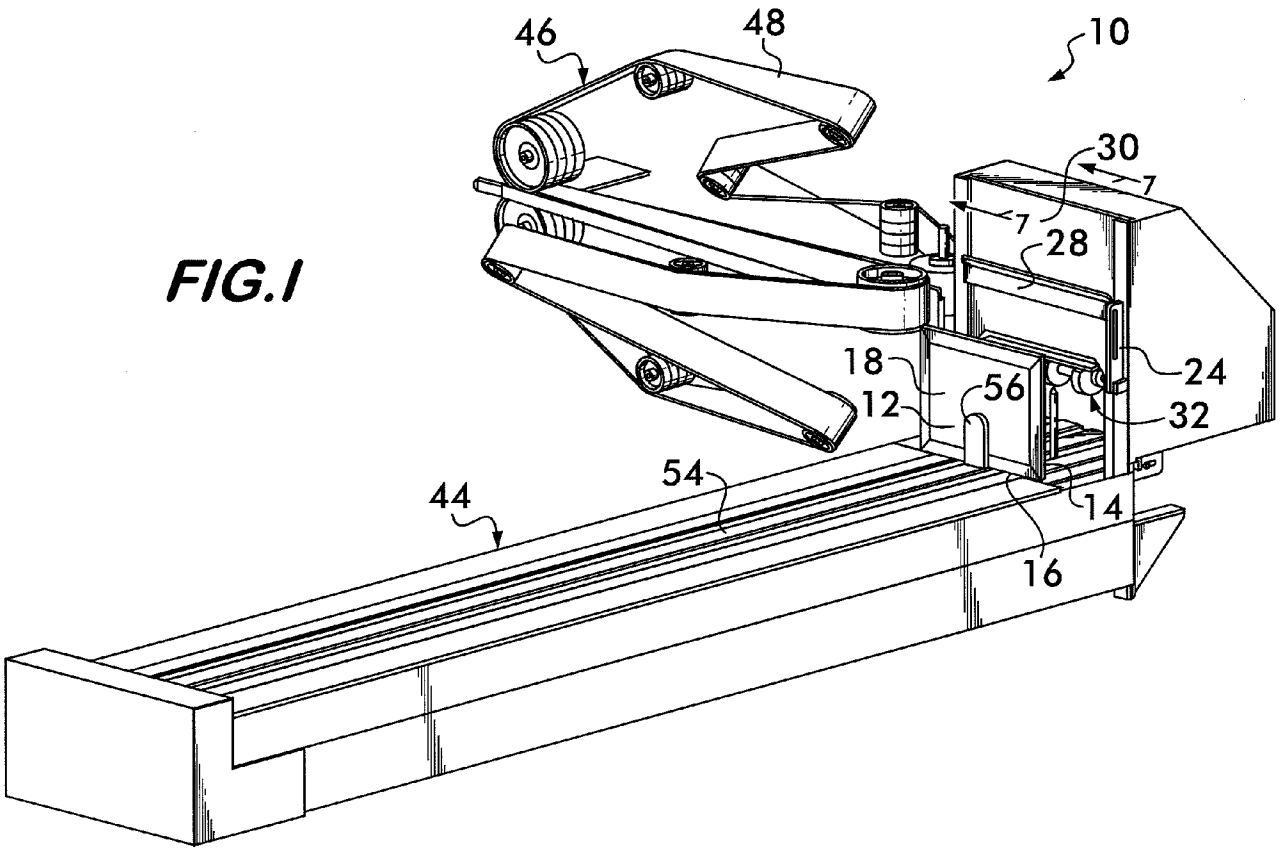
FIG. 1 is an isometric view of a large envelope on-edge stacking conveyor in accordance with one preferred embodiment of the present invention.

The invention will be illustrated in more detail with reference to the following embodiments, but it should be understood that the present invention is not deemed to be limited thereto.

Referring now to the drawing figures wherein like part numbers refer to like elements throughout the several views, there is shown in FIGS. 1-9 a stacking apparatus 10 for stacking a plurality of flat articles 12 on edge, each article 12 having a front perimeter edge 14, a bottom edge 16 and two faces 18, 20. The stacking apparatus 10 receives the flat articles 12, e.g., large envelopes, via an article receiver 22 such that the faces 18, 20 of the article 22 are generally in a vertical position. The article receiver 22 includes a stop wall 24 to receive the front perimeter edge 14 of each article 12 which stops horizontal motion of the article 12 and aligns the front perimeter edge 14 of each article 12 such that a stack 26 of envelopes is formed. The article receiver 22 also preferably includes a front guide 28 and a back wall 30 for guiding each article 12 to the stop wall. A rotatable segmented roller 32 forms the bottom of the article receiver 22 which supports the bottom edge 16 of each article 12.

Figure 2:
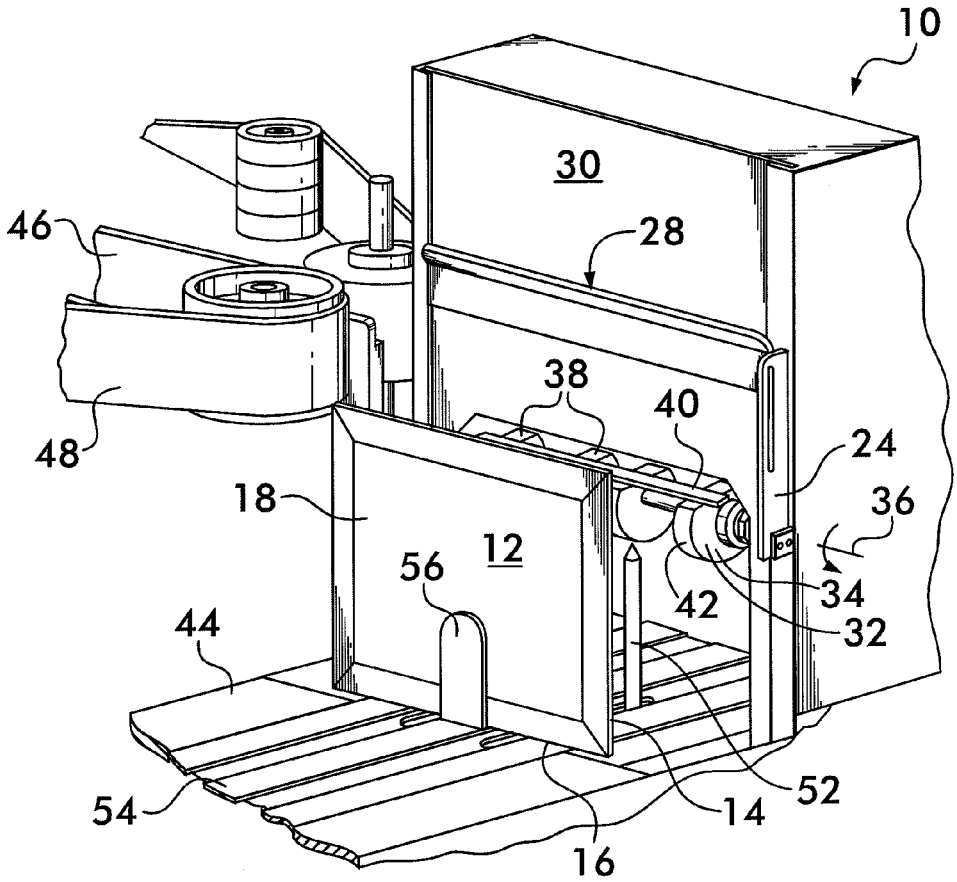
FIG. 2 is an enlarged, partial isometric view of the large envelope on-edge stacking conveyor of FIG. 1.
Figure 4:
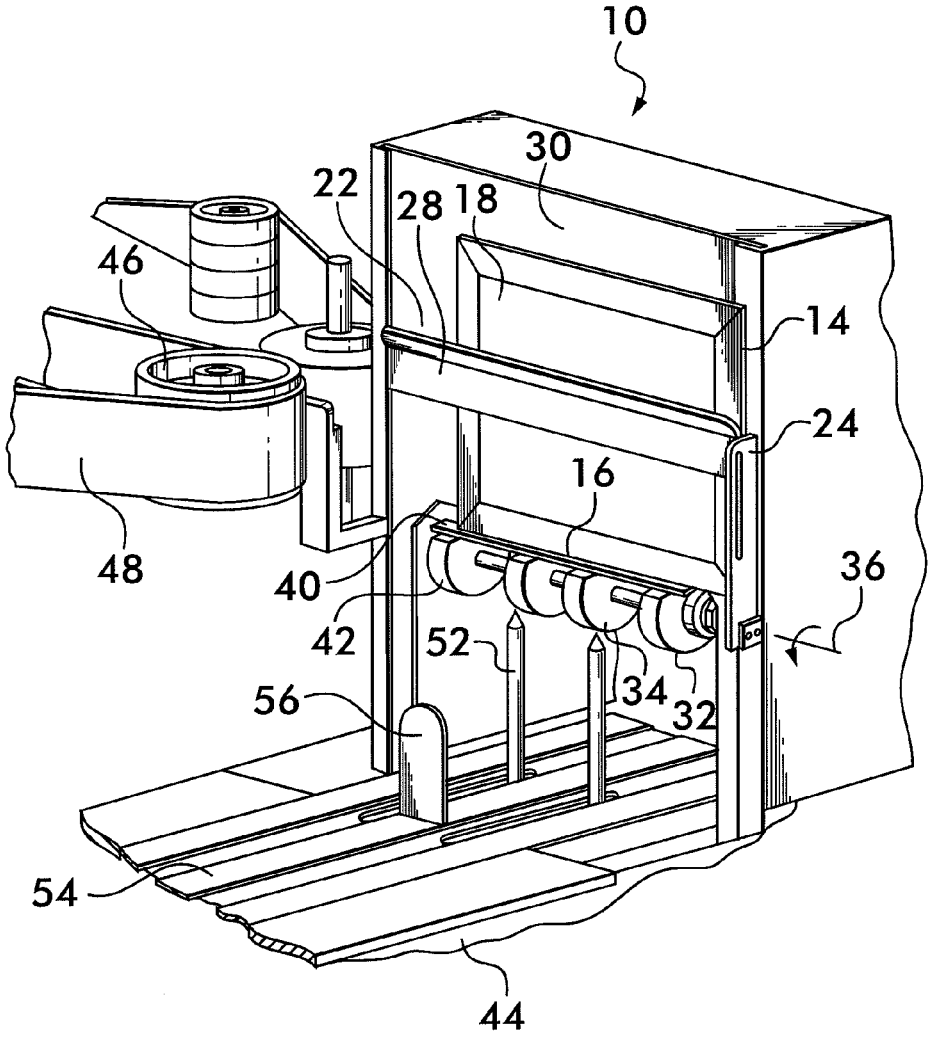
FIG. 4 is an enlarged, partial isometric view of the large envelope on-edge stacking conveyor of FIG. 1, showing an incoming envelope against a stop wall and segmented rollers prior to beginning of rotation.
Figure 6:
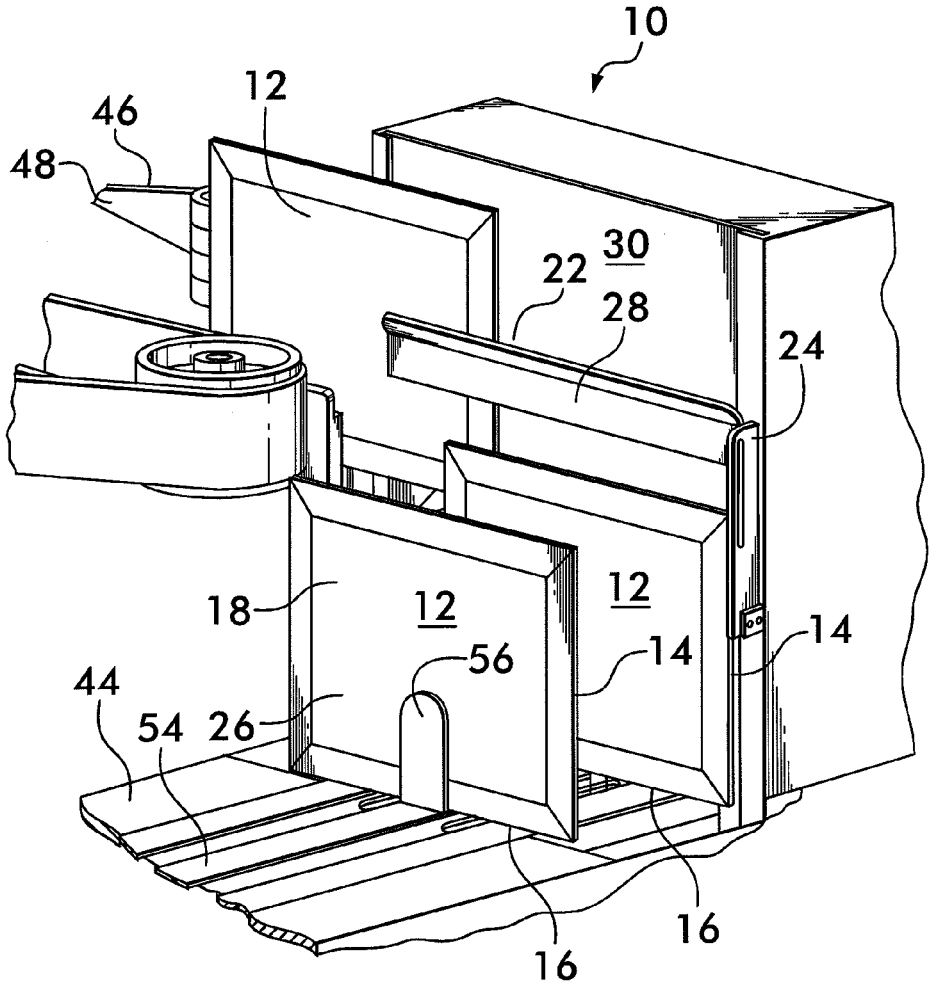
FIG. 6 is an enlarged, partial isometric view of the large envelope on-edge stacking conveyor of FIG. 1, showing an envelope coming into the conveyor and another envelope indexed down to the conveyor bed.
Figure 7:
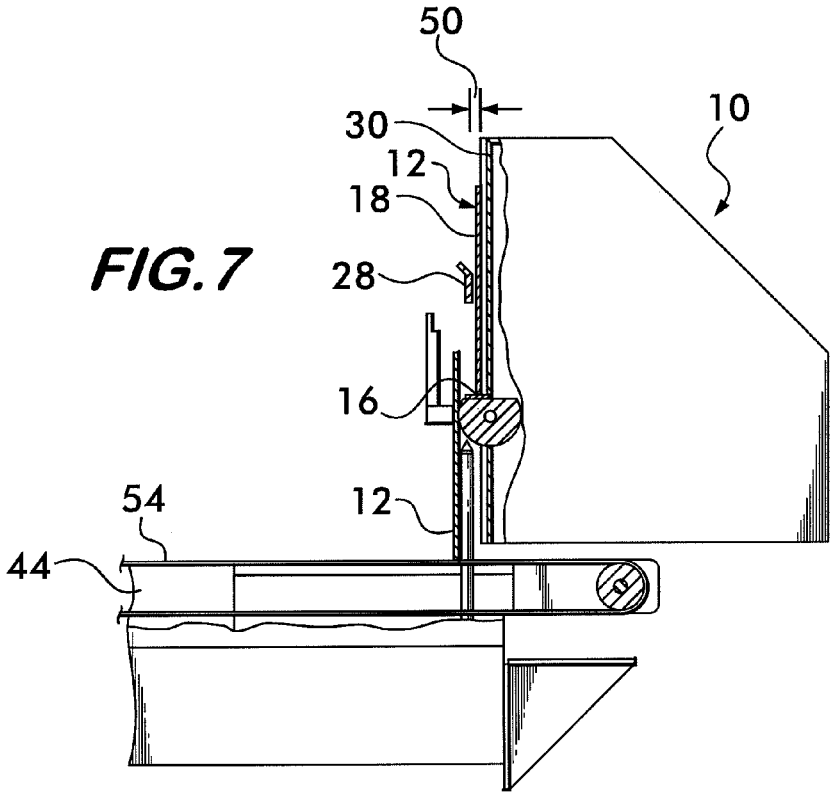
FIG. 7 is a partial cross-sectional, side, elevation view of the large envelope on-edge stacking conveyor of FIG. 1, showing an incoming envelope above the segmented roller.

As seen in FIGS. 2, 4 and 7, the segmented roller 32 is an elongated cylinder 34 (or set of cylinders) that is rotatable about a horizontal central axis 36 of the cylinder 34. The cylinder 34 includes one or more planar surfaces 38 located on the cylinder 34 where each planar surface 38 is substantially parallel to the horizontal central axis 36 of the cylinder 34. The cylinder 34 also has a generally cylindrical outer surface 42 (except for the planar surface 38). The planar surface 38 forms a shelf 40 to receive the bottom edge 16 of each article 12 when each article 12 enters the article receiver 22 when the planar surface is rotated to a horizontal position as shown in FIGS. 2, 3, 4 and 7.

As seen in FIGS. 1-9, the stacking apparatus 10 further includes a stacking conveyor bed 44 for receiving articles 12 as they pass through the article receiver 22, as follows. Preferably, the articles 12 move from a belt turn-up mechanism 46 as shown most clearly in FIGS. 1 and 3 into the article receiver 22. The belt turn-up mechanism 46 turns the articles, one at a time, from flat (i.e., horizontal) to on-edge (i.e., with the faces 18, 20 of the article in a vertical position). Preferably, the design on this belt turn-up mechanism 46 utilizes a single belt 48 and a single belt turn-up mechanism 46 that can be configured to turn the article 12 either clockwise or counterclockwise at the time of assembly of the system. At a point located either upstream or downstream from the belt turn-up mechanism 46, an electronic reading device (not shown) that can detect a parameter such as zip code break mark on the incoming envelope may be included.

When each article 12 passes through the belt turn-up mechanism 46 into the article receiver 22, the segmented roller 32 has been rotated to a stopped position such that the planar surface 38 is in the (upper) horizontal position such that the planar surface 38 forms a gap 50 and receives the bottom edge 16 of each article. Once the article 12 is fully received into the article receiver 22, the segmented roller 32 rotates such that the cylindrical outer surface 42 of the segmented roller 32 drives the article 12 down to the stacking conveyor bed 44. The segmented roller 32 continues to rotate for a full three hundred sixty degrees (in a configuration where only one planar surface 38 is present on the segmented roller 32) back to the stopped position wherein the planar surface 38 is in a horizontal position to receive the bottom edge 16 of another article 12.

Figure 9:
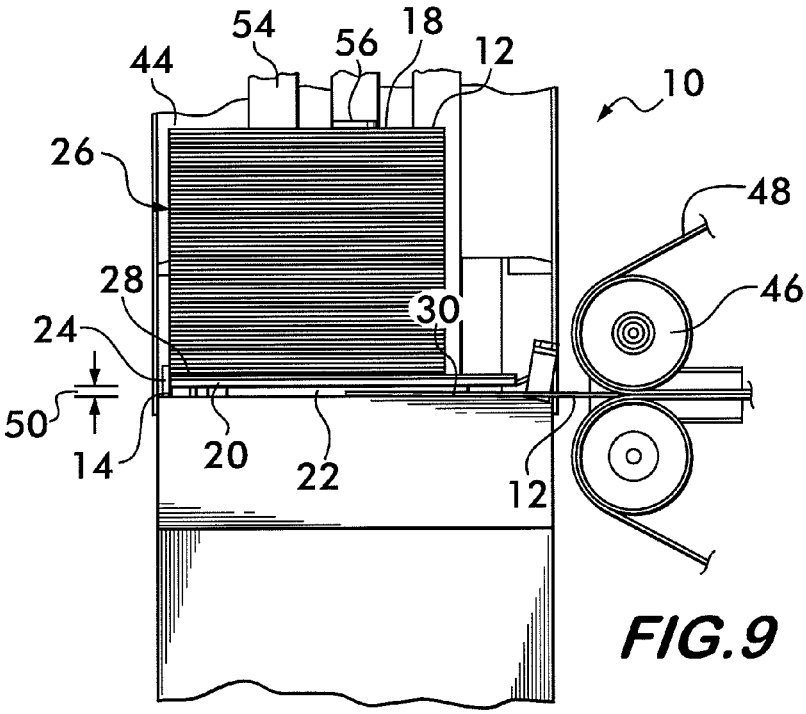
FIG. 9 is a partial, top, plan view of the large envelope on-edge stacking conveyor of FIG. 1, showing an envelope stack and a series of offset envelopes.
Figure 8:
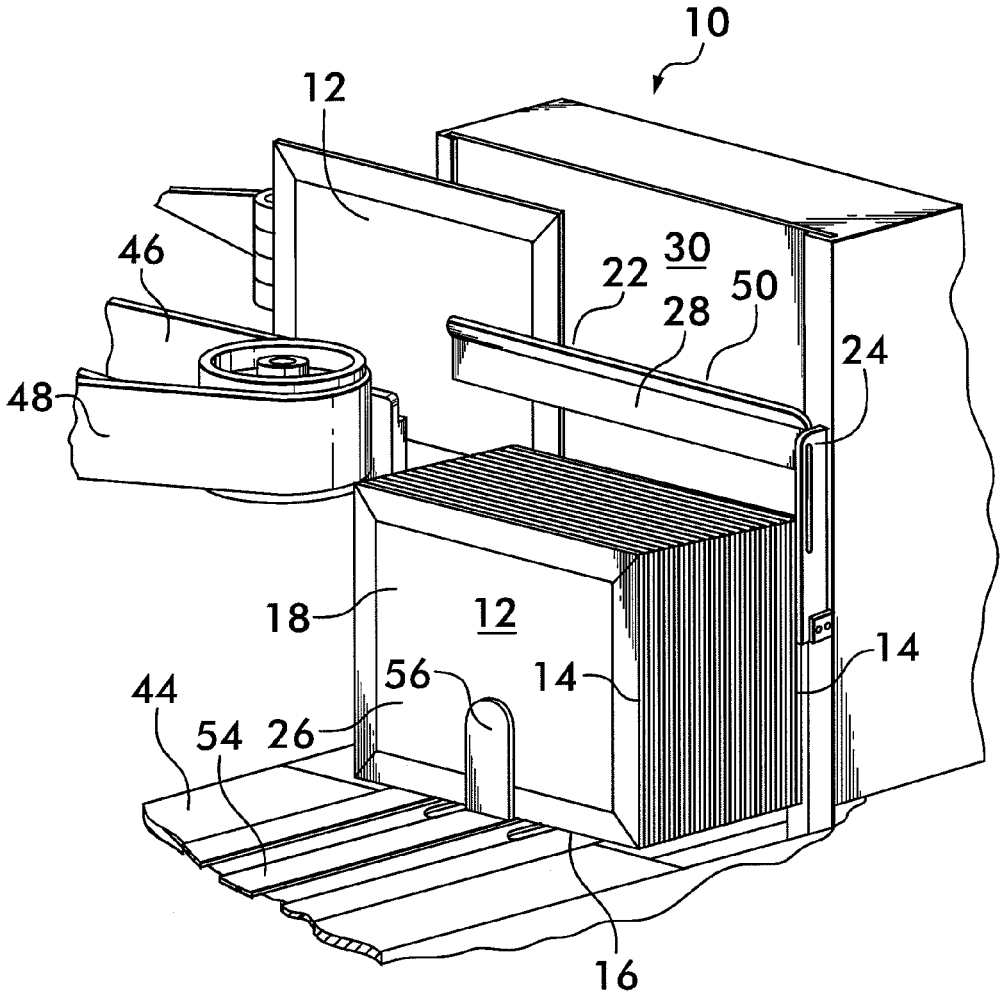
FIG. 8 is a partial, isometric view of the large envelope on-edge stacking conveyor of FIG. 1, showing an envelope coming into the conveyor bed and a stack of envelopes formed on the bed.

As best seen in FIG. 9, the segmented roller 32, when in the horizontal position, maintains a gap 50 for the article 12 to enter completely behind the previously stacked articles in the stack 26 of articles. When the article 12 reaches the stop wall 24 (see FIG. 4), the segmented roller 32 begins to rotate down (counterclockwise as shown in the figures), allowing the article 12 to start to drop. As the article 12 continues to drop, the segmented roller 32, which has a high friction outer surface 42, assists in driving the article 12 to the stacking conveyor bed 44 (see FIG. 6). As this article 12 is driven to the stacking conveyor bed 44, it is also moved forward by the radius of the segmented roller 32 to offer the gap 50 for the next incoming article (see FIG. 7). The stack 26 of articles 12 is formed on the conveyor bed 44 against an article face receiver 56. Once on the stacking conveyor bed 44, a sensor 52, preferably a pressure sensor, monitors the tightness of the article stack 26, and indexes the conveyor bed belt 54 to ease the stack tightness, allowing room for the next article 12 or articles to move down onto the stacking conveyor bed 44.

Another desirable feature of the stacking apparatus 10 is an ability to offset the registered edge of the horizontal article stack 26 so to easily identify parameters, for example, a zip code change, article count, or electronic signal to an offloading operator. This is accomplished, for example, by a printing (zip code, bar code, optical mark, and the like) being read on the article 12 by a separate reading device (not shown) as the article 12 enters or leaves the belt turn-up mechanism 46. This data is then used to index a motor to cause the register edge, e.g., the front perimeter edge 14, of the article stack to be offset from the articles received earlier stack 26. This is taught, for example, in U.S. Pat. No. 6,682,067, the complete specification of which is hereby fully incorporated by reference. See FIG. 9. This can be accomplished, for example, by an article stack offset device (not shown) that periodically moves the stop wall to provide the mark for the change.

The article face receiver 56 on the stacking conveyor bed 44 is indexed on the conveyor bed 44 to provide for an incremental amount of space for additional articles received on the conveyor bed 44 as articles enter the stack 26. When the sensor 52 senses that the faces 18, 20 of the articles 12 are sufficiently tight against one another, the conveyor bed belt 54 indexes to allow for more space for additional articles 12.

Optionally, the segmented roller 32 may be rotated at a continuous rate. Here however, the input of articles 12 by the belt turn-up mechanism 46 into the article receiver 22 must be perfectly timed to provide for each article 12 to enter the article receiver 22 while the planar surface 38 is horizontal.

While the invention has been described in detail and with reference to specific embodiments thereof, it will be apparent to one skilled in the art that various changes and modifications can be made therein without departing from the spirit and scope thereof.

What is claimed is:

1. A stacking apparatus for stacking a plurality of flat articles on edge, each article having a front perimeter edge, a bottom edge and two faces, said stacking apparatus adapted to receive each of said plurality of flat articles as each article enters said stacking apparatus, moving in a direction generally parallel to said faces of each article, said stacking apparatus comprising:

(a) an article receiver, the article receiver adapted to receive articles wherein the faces of the article are in a vertical position, comprising
  (i) a stop wall to receive the front perimeter edge of each article and stop horizontal motion of the article and to align the front perimeter edge of each article;
  (ii) a rotatable segmented roller for receiving the bottom edge of each article; and
  (iii) a front guide and a back wall;

(b) the segmented roller comprising:
  (i) an elongated cylinder rotatable about a horizontal central axis of the cylinder, said central axis of said cylinder being parallel to said faces of the article in said article receiver;
  (ii) at least one planar surface that is substantially parallel to the horizontal central axis of the cylinder, the planar surface forming a shelf to receive the bottom edge of each flat article when each article enters the article receiver when the planar surface is rotated to a horizontal position; and
  (iii) a generally cylindrical outer surface;

(c) a stacking conveyor bed; and (d) the segmented roller rotatable from a stopped position wherein the planar surface is in the horizontal position wherein the planar surface forms a gap to receive the bottom edge of one article at a time to a rotating configuration wherein the cylindrical outer surface of the segmented roller drives the one article against the stacking conveyor bed, and rotatable back to the stopped position wherein the planar surface is in a horizontal position to receive the bottom edge of another article.

2. The stacking apparatus of claim 1, including a belt turn-up mechanism to turn the article from a position wherein the faces of the article are in a position other than vertical to a position wherein the faces are in a vertical position, for receipt into the article receiver.

3. The stacking apparatus of claim 1, including an article face receiver on the stacking conveyor bed, wherein the article face receiver is indexed on the conveyor bed to provide for an incremental amount of space for additional articles received on the conveyor bed.

4. The stacking apparatus of claim 3, including a stack pressure sensor, wherein the article face receiver is indexed when the stack pressure sensor senses sufficient pressure caused by a stack of articles on the conveyor bed.

5. The stacking apparatus of claim 1, wherein conveyor bed is movable along a conveyor to provide additional space, as required, for articles and for providing a compressive force to the stack of articles.

6. The stacking apparatus of claim 1, wherein said segmented roller includes a single planar surface and is adapted to rotate three hundred sixty degrees for each article received.

7. The stacking apparatus of claim 1, wherein the segmented roller is adapted to be stationary during the receiving of each article and subsequently rotates to drive that article against the stacking conveyor bed.

8. The stacking apparatus of claim 1, wherein the segmented roller includes a single planar surface, the segmented roller is adapted to be stationary during the receiving of each article when the planar surface is in the horizontal position and the segmented roller is then adapted to rotate three hundred sixty degrees for each article received.

9. The stacking apparatus of claim 1, wherein the segmented roller is adapted to rotate at a continuous rate.

10. The stacking apparatus of claim 1, including an article stack offset device to periodically move the stop wall to provide a mark for a change in an article parameter.

11. The stacking apparatus of claim 1, including an article stack offset device to periodically move said stop wall to provide a mark for a change in an article parameter, the article stack offset device adapted to offset said articles at specific article counts.

12. The stacking apparatus of claim 1, including an article stack offset device to periodically move said stop wall to provide a mark for a change in an article parameter, said article stack offset device adapted to offset the articles when an electronic signal is received.

* * * * *